US007056155B2

(12) United States Patent
Fan

(10) Patent No.: US 7,056,155 B2
(45) Date of Patent: Jun. 6, 2006

(54) MEMORY CARD CONNECTOR

(75) Inventor: Chia Hao Fan, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,270

(22) Filed: Nov. 30, 2004

(65) Prior Publication Data

US 2005/0130498 A1 Jun. 16, 2005

(30) Foreign Application Priority Data

Dec. 12, 2003 (CN) ..... 2003 2 0120740

(51) Int. Cl.
*H01R 24/00* (2006.01)

(52) U.S. Cl. ..... 439/630; 439/607

(58) Field of Classification Search ..... 439/630, 439/64, 607, 541.5, 79
See application file for complete search history.

(56) References Cited

U.S. PATENT DOCUMENTS 5,320,552 A * 6/1994 Reichardt et al. ..... 439/331
6,039,599 A * 3/2000 Benjamin et al. ..... 439/489
6,168,082 B1 * 1/2001 Benjamin et al. ..... 235/475
6,234,809 B1 * 5/2001 Futatsugi ..... 439/64
6,402,529 B1 6/2002 Saito et al.
6,558,199 B1 * 5/2003 Oguchi ..... 439/630
6,565,386 B1 * 5/2003 Yoneyama et al. ..... 439/607
6,609,919 B1 8/2003 Ito et al.
6,641,413 B1 11/2003 Kuroda
6,716,066 B1 * 4/2004 Kuo ..... 439/630
6,857,907 B1 * 2/2005 Hung et al. ..... 439/630

* cited by examiner

*Primary Examiner*—Gary F. Paumen
(74) *Attorney, Agent, or Firm*—Wei Te Chung

(57) ABSTRACT

An electrical card connector (100) adapted for accepting memory cards includes an insulative housing (2), a terminal module (3) received in the housing and a metal shell (1) substantially covering the housing. The housing includes a card receiving space (24) and an upper wall (20). A row of slots (2031) are defined in inner side surface of the upper wall. The terminal module includes an insulative casing (31) and a number of first and second terminals (32*a*, 32). The first and second terminals respectively includes first and second mounting portions (322*a*, 322) fixed in the casing, first and second body portions (321*a*, 321) alternately held in corresponding slots of the upper wall, and first and second contacting portions (323*a*, 323) arranged in two lines in the card receiving space for electrically connecting with the card.

14 Claims, 13 Drawing Sheets

MEMORY CARD CONNECTOR

CROSS-REFERENCE TO RELATED APPLICATIONS

This application is related to U.S. patent applications entitled "MEMORY CARD CONNECTOR", entitled "CONNECTOR FOR MEMORY CARDS", and entitled "CONNECTOR FOR MEMORY CARDS", invented by the same inventor and assigned to the common assignee as the present invention.

BACKGROUND OF THE INVENTION

1. Filed of the Invention

The present invention relates to a card connector which can be mounted on electronic device, and more particularly to a compact card connector capable of containing multiple cards.

2. Description of the Prior Art

Usually, memory cards used for consumptive electronic products, such as digital cameras, MP3 players or the PDAs, mostly can be classified into seven standard memory cards, a multi-media card (MMC), an xD-picture card (XD), a secure digital card (SD), a smart media card (SM), a compact flash card (CF) including type I and type II and the memory stick card (MS). Wherein, the only difference between the SD card and the MMC card is the number of contact pins so that a common slot socket of the read and write apparatus is enough for both of the cards. Such various kinds of memory cards have different shapes, such as a long one, a short one, a thick one, or a thin one. Thus various kinds of card connector apparatuses corresponding to these memory cards have been developed.

An example of a conventional electronic card connector is disclosed U.S. Pat. No. 6,641,413 B2 issued to Kuroda on Nov. 4, 2003. The Kuroda card connector includes a housing including a storage portion, a plurality of first and second terminals arranged in two lines in front and in rear in a card insertion direction of the storage portion, a slide member disposed to be movable in the card insertion direction and lock means for locking the slide member at a card installation position. The slide member provides a presser plate portion to come in contact with the first terminals at a card ejection position to restrain the first terminals from protruding into the storage portion. The slide member further provides a first fastening portion allowing the second card to pass without contact and coming in contact with only a front end portion of the first card, and a second fastening portion behind the first fastening portion contacting with only a front end portion of the second card.

However, the structure of the slide member in Kuroda connector is complex. Moreover, the Kuroda connector arranges the slider member in addition to restrain the terminals, and thus the housing must define additional fixing element such as a groove or a cavity, to address the slide member. It is obviously complicated and maximized, and thus the cost of the connector is relatively high.

U.S. Pat. No. 6,402,529 B2 issued to Saito et al. on Jun. 11, 2002 discloses another typical card connector. The Saito connector includes a housing including an upper plate, a lower plate and two plates. The lower plate defines a plurality of alternate longer and shorter slots for respectively receiving longer and shorter terminals. However, the lower plate is relatively weak and is easily to be distorted due to the crowded longer and shorter slots. Moreover, the longer and shorter terminals are received in the slots without any holding means, such that the longer and shorter terminals may be deflected up and destroyed by frequently insertion of the insertion cards.

Hence, an improved card connector with reliable terminals is desired to overcome the above-mentioned shortcomings.

BRIEF SUMMARY OF THE INVENTION

A main object of the present invention is to provide a compact card connector capable of reliably containing multiple cards therein.

Another object of the present invention is to provide a compact and simple connector can be easily manufactured.

A further object of the present invention is to provide a card connector which is robust and has a long-life span.

In order to achieve the objects mentioned above and others, one embodiment of an electrical card connector adapted for accepting memory cards includes an insulative housing, a terminal module received in the housing and a metal shell substantially covering the housing. The housing includes a card receiving space and an upper wall. A row of slots are defined in inner side surface of the upper wall. The terminal module includes an insulative casing and a plurality of first and second terminals. The first and second terminals respectively includes first and second mounting portions fixed in the casing, first and second body portions respectively extending from the first and second mounting portions and first and second contacting portions. The first and second body portions are alternately held in corresponding slots of the upper wall. The first and second contacting portions are arranged in two lines in the card receiving space for electrically connecting with the card.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE INVENTION

Figure 1:
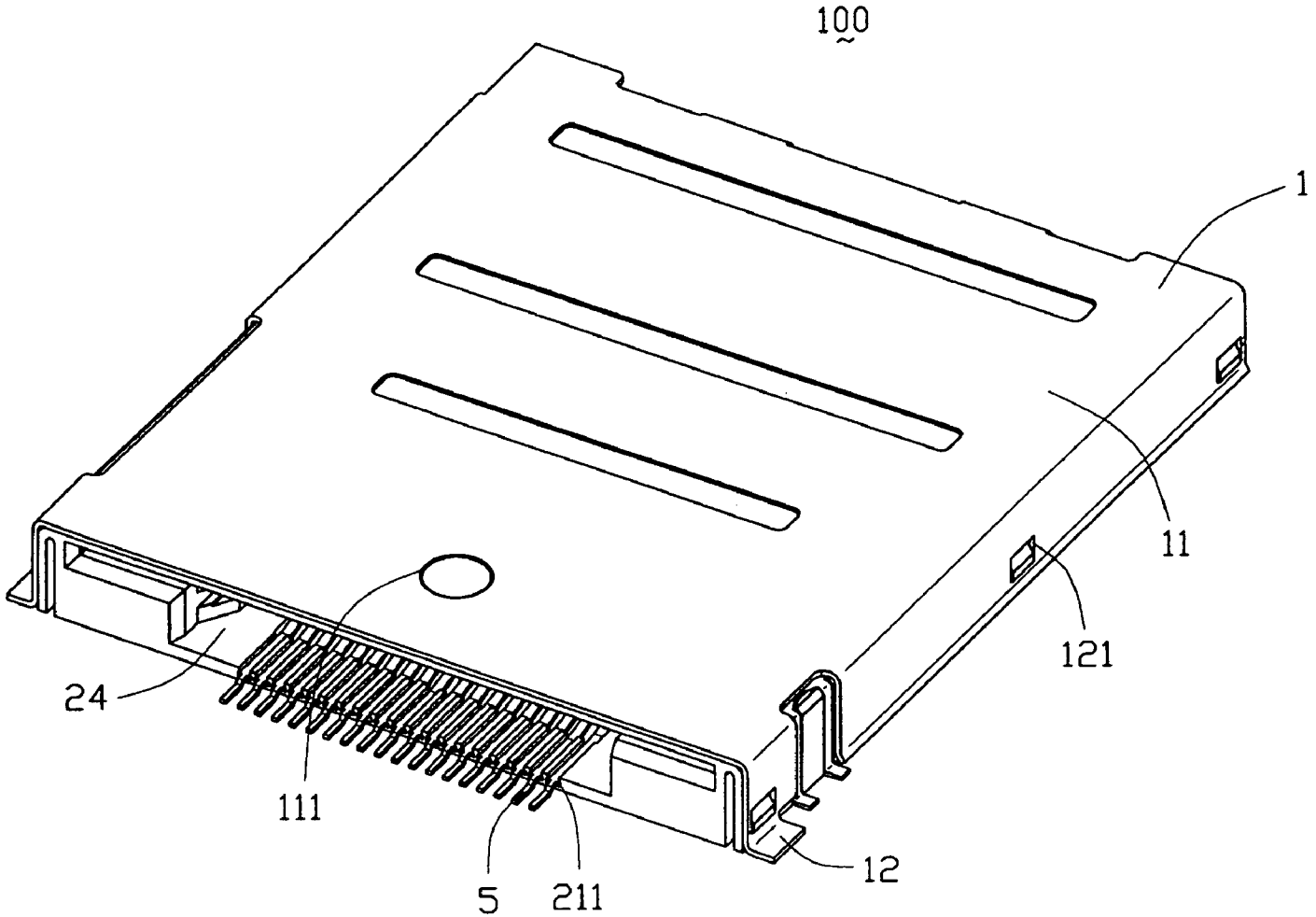
FIG. 1 is a perspective view of an electrical card connector in accordance with the present invention.

The present invention will now be described with reference to drawings, and first to FIGS. 1 and 4. An electrical card connector 100 according to the present invention for mounting on a PCB (not shown) is of generally rectangular shape and comprises a housing 2, an outer shell 1 covering the housing 2, a terminal module 3 embedded in the housing 2 and a positioning member 4. A plurality of terminals, designated numeral 5, are disposed in the housing 1 of the card connector 100. In the preferred embodiment, such terminals 5 are provided for mating with an xD-picture card (XD). For convenience, such terminals are referred to hereafter as XD terminals 5. The card connector further includes a grounding contact 6, a pair of switch contacts 7, a written contact 8 and a pair of written protection contacts 9. The structure and the function of the grounding contact 6, the switch contacts 7, the written contact 8 and the written protection contacts 9 are well known to those skilled in the art, a detailed description is omitted herein.

Referring to FIGS. 2–5, the housing 2 is made of insulating material such as synthetic resin and is formed into a square box shape. The housing 2 comprises an upper wall 20, a bottom wall 21 and a pair of left and right sidewalls 22, 23 connecting the upper wall 20 to the bottom wall 21 thereby forming a card receiving space 24 therebetween for receiving multiple memory cards (not shown).

Figure 5:
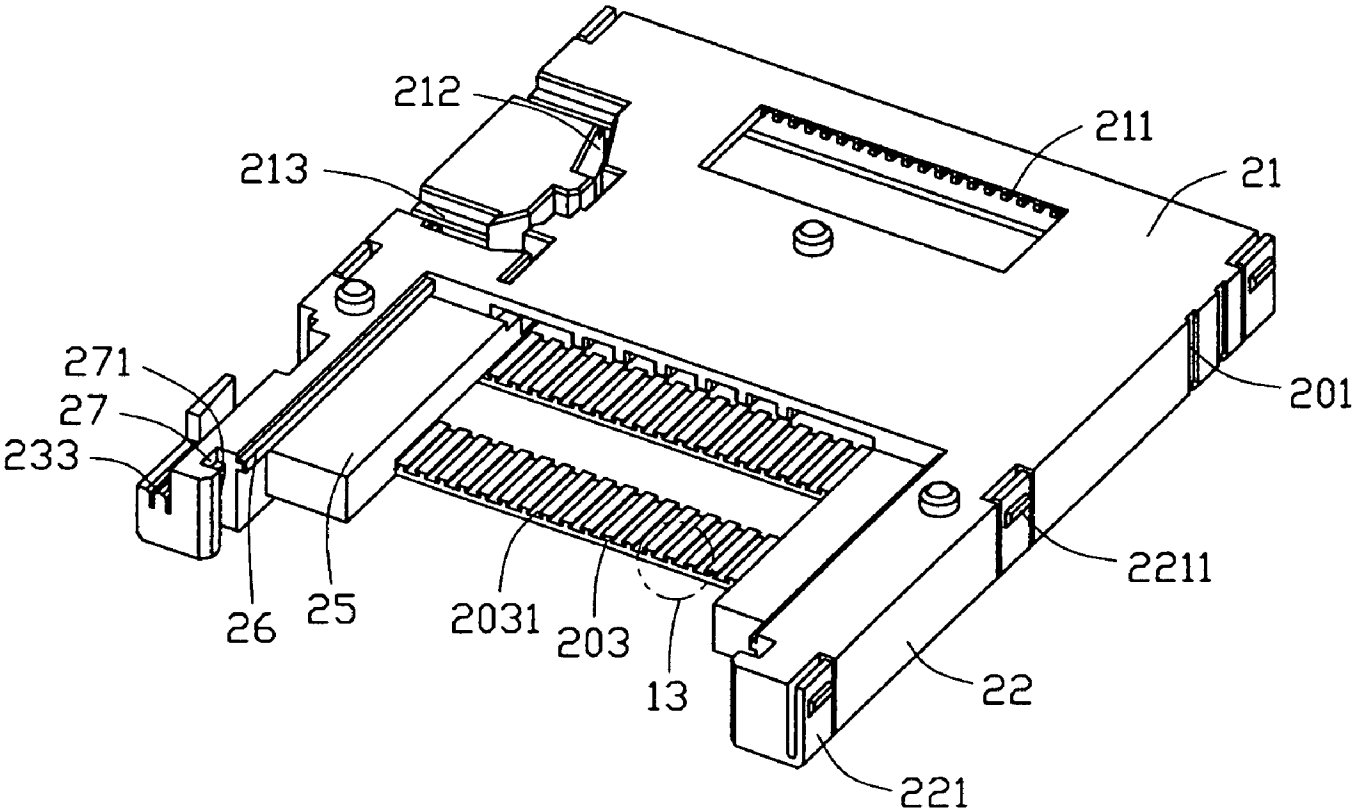
FIG. 5 is a perspective view of an insulative housing shown in FIG. 4, taken from bottom aspect.
Figure 13:
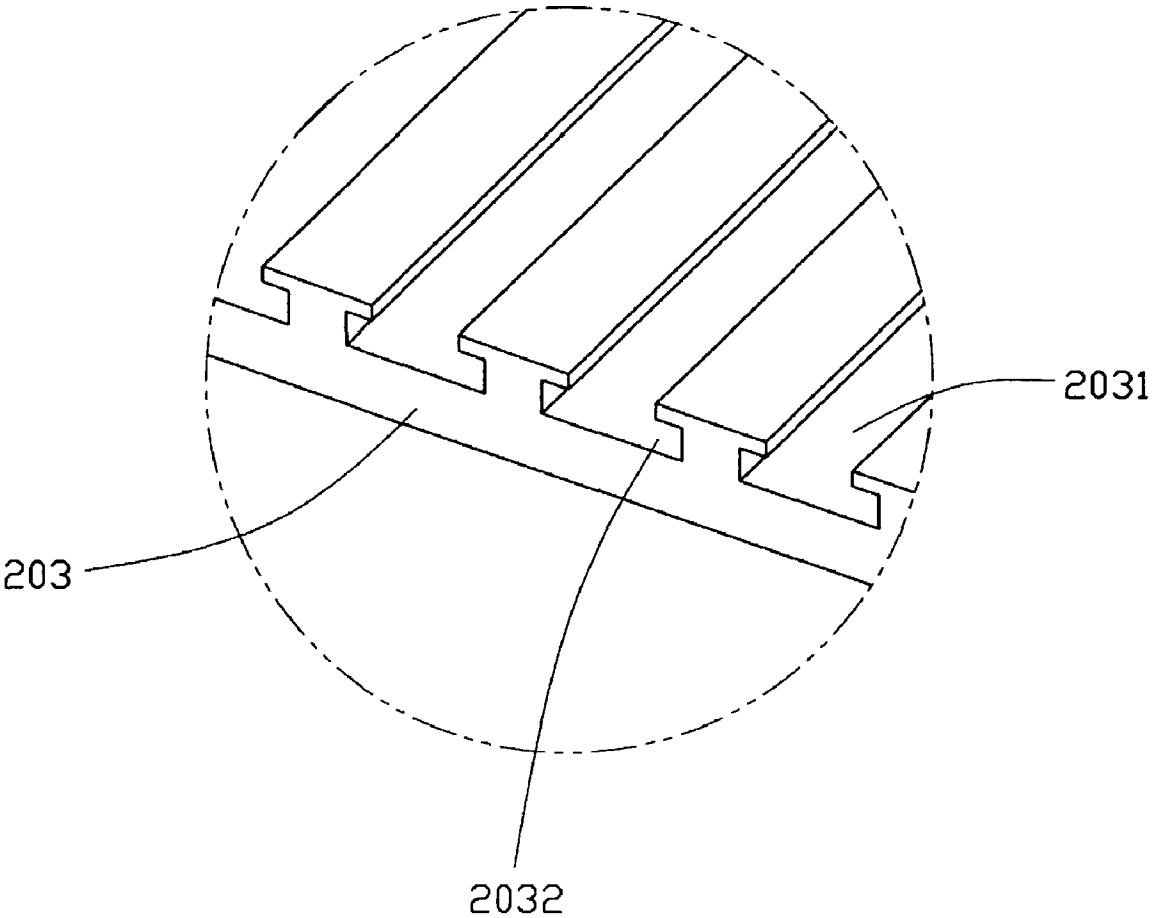
FIG. 13 is an enlarged view of FIG. 5, specially showing slots.

The upper wall 20 of the housing 2 includes a pair of written protection contact mounting recesses 201 in a front portion thereof for receiving the written protection contacts 9 and a protrusion 202 projecting upwardly from a front middle portion thereof for latching with the outer shell 1. A front, middle and rear longitudinal cutouts (not labeled) are spaced defined in the upper wall 20, thereby forming a front and rear parallel crossrails 203 between adjacent two cutouts. A row of T-shaped slots 2031, as best shown in FIGS. 5 and 13, are defined in an inner side surface of the crossrails 203 and communicating with the card receiving space 24. A pair of grooves 2032 extends laterally from inner side surfaces of each slot 2031.

A plurality of passages 211 are spaced along a front inner side surface of the bottom wall 21 of the housing 2 and communicate with the card receiving space 24. A grounding contact mounting recess 212 and a written contact mounting recess 213 are defined in the bottom wall 21 adjacent to the right sidewall 23. The grounding contact mounting recess 212 and the written contact mounting recess 213 communicate with each other and respectively for receipt the grounding contact and the written contact 9 therein.

Figure 11:
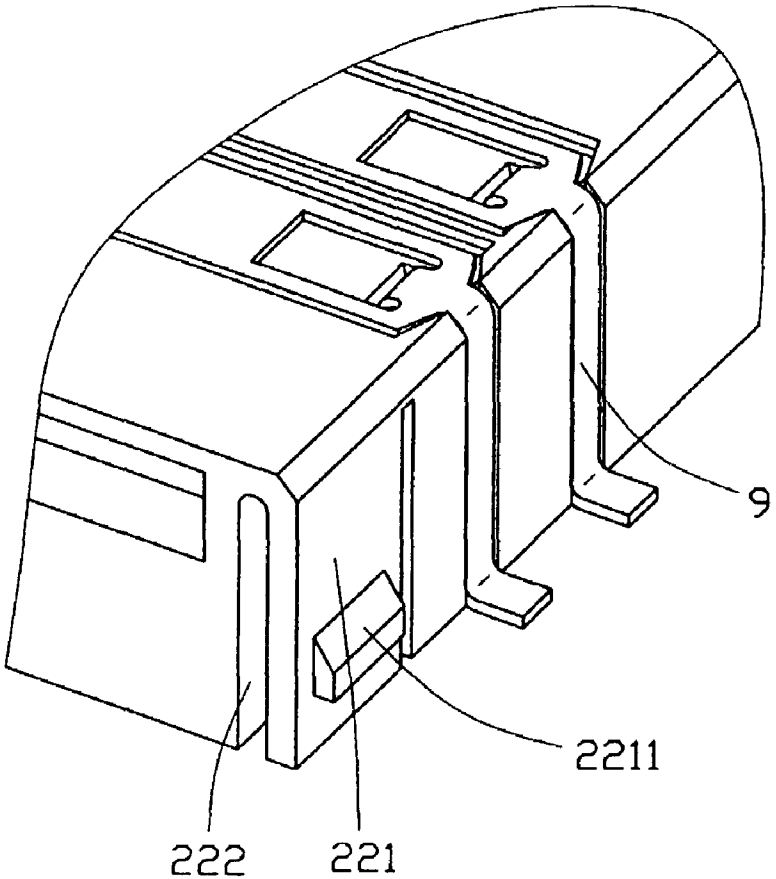
FIG. 11 is a partially enlarged view of FIG. 2, specially showing a sidewall the insulative housing.

The left and right sidewalls 22, 23 of the housing 2 respectively have a plurality of cantilevered flaps 221, 231. The flaps 221, 231 respectively extending downwardly from outer edges of the left and right sidewalls 22, 23 and are essentially parallel to and laterally offset from the left and right sidewalls 22, 23, thereby forming a plurality of gaps 222, 232, specially shown in FIG. 11, between inner side surfaces of corresponding flaps and outer surfaces of the left and right sidewalls 22, 23. Each flap 221, 231 forms a locking portion 2211, 2311 projecting outwardly therefrom for engaging with the outer shell 1. Each locking portion 2211, 2311 has a trapeziform cross-section. A top surface of the locking portion 2211, 2311 is an inclined surface acting as a lead-in surface during the outer shell 1 being attached to the housing 2, and a bottom surface of the locking portion 2211, 2311 is perpendicular to an outer side surface of the flap 221. 231. The right sidewall 23 further defines a pair of switch contact mounting recesses 233 in a lower rear portion for receiving the switch contacts 7 therein. A pair of guiding columns 25 are formed on opposite side of the bottom wall 21 adjacent to the left and right sidewalls 22, 23. A pair of ribs 26 respectively project inwardly from inner side surfaces of the left and right sidewalls 22, 23. The ribs 26 are dimensioned and positioned above the columns 25 for engaging with the terminal module 3, which will be discussed more detailed hereinafter. A pair of cavities 27 are defined on a rear portion of opposite sidewalls 22, 23 and communicate with the card receiving space 24. Each cavity 27 forms an embossment 271 for engaging with the positioning member 4, as will be more fully discussed.

Figure 4:
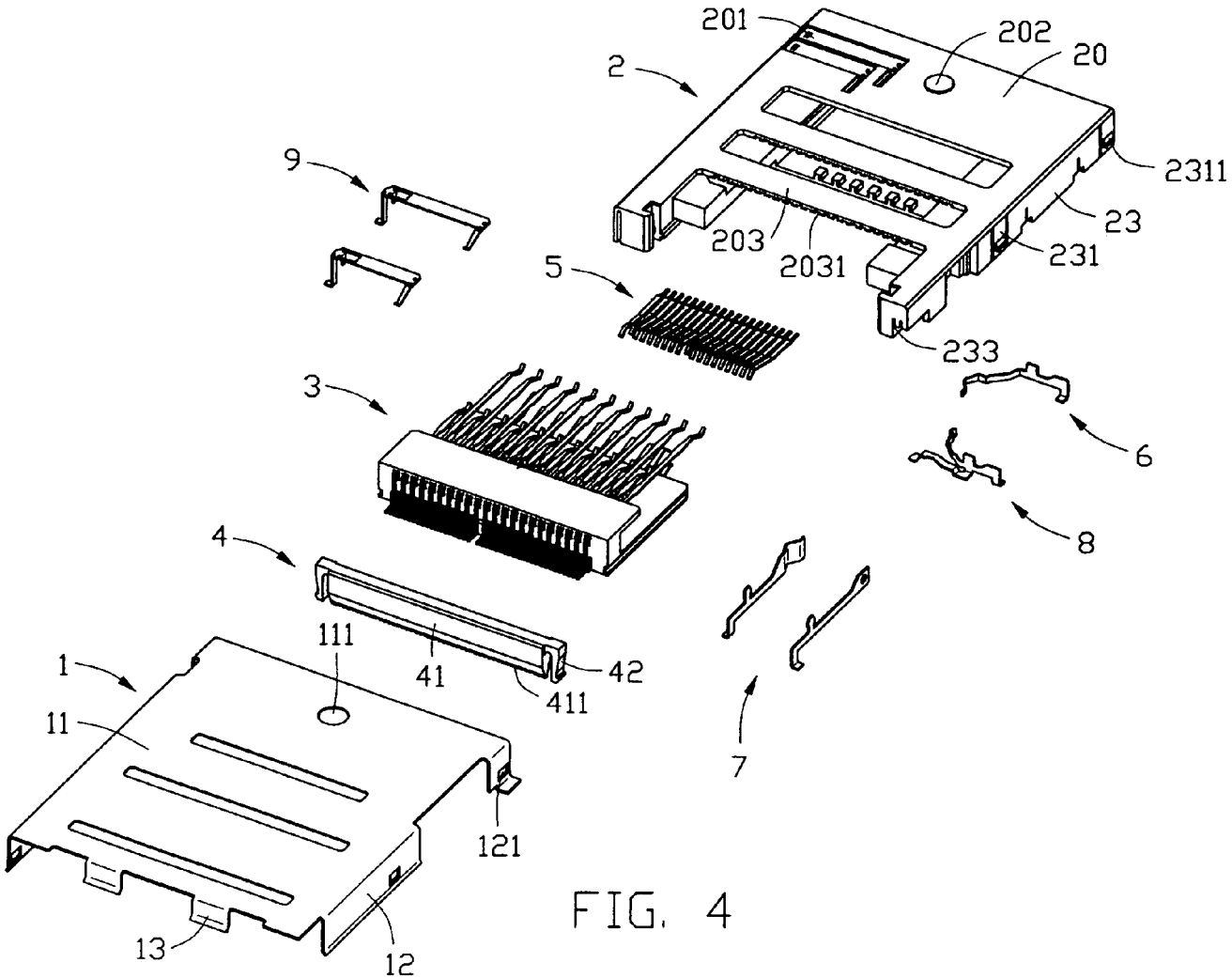
FIG. 4 is an exploded view of FIG. 1.
Figure 12:
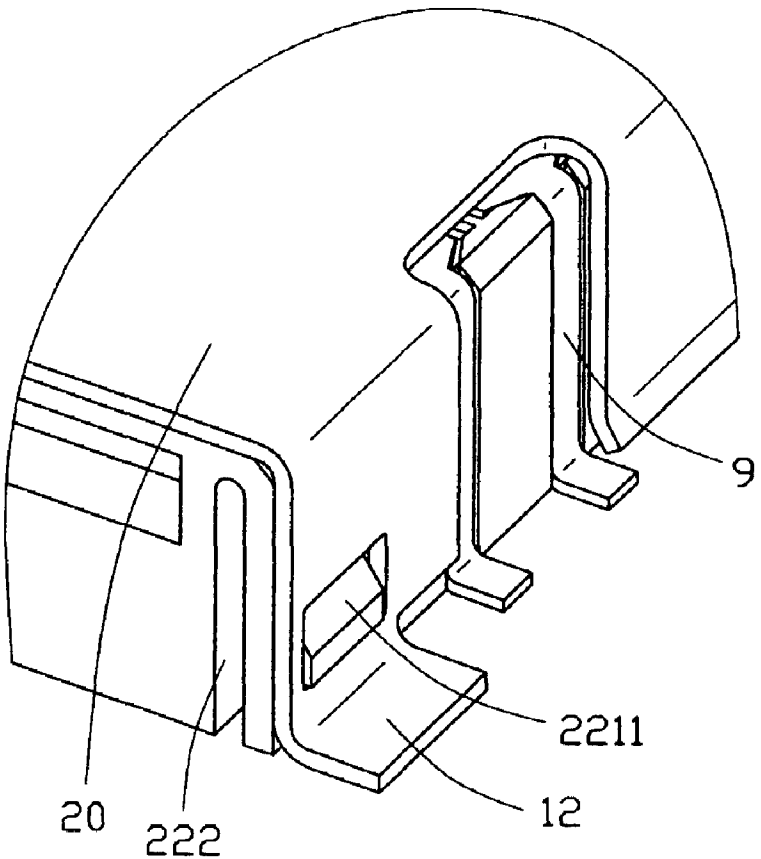
FIG. 12 is a partially enlarged view of FIG. 1, specially showing a side plate of the outer shell engaging with the sidewall of the insulative housing.

Referring to FIGS. 1, 4 and 12, the outer shell 1 is formed with a metal sheet and provided for covering the housing 2. The shell 1 includes a top plate 11, a pair of side plates 12 extending downwardly from opposite sides of the top plate 11 and a rear plate 13 extending downwardly from a rear end of the top plate. The top plate 11 defines an aperture 111 for engaging with the protrusion 202 of the housing 2. Each side plate 12 defines a plurality of locking holes 121 for engaging with the locking portion 2211, 2311 of the housing 2.

Referring to FIGS. 6–10, the terminal module 3 includes an insulative casing 31 and a plurality of first, second, and third conductive terminals 32 (32*a*), 33, 34 received in the insulative casing 31. In the preferred embodiment, the first and second terminals 32 (32*a*), 33 are respectively provided for mating with a Smart Media Card (SM) and a Memory Stick Card (MS). The third terminals 34 are provided for mating with a secure digital card (SD) or a multi-media card (MMC). For convenience, such first, second and third terminals 32 (32*a*), 33, 34 are respectively referred to hereafter as SM terminals 32, MS terminals 33 and SD terminals 34.

Figure 6:
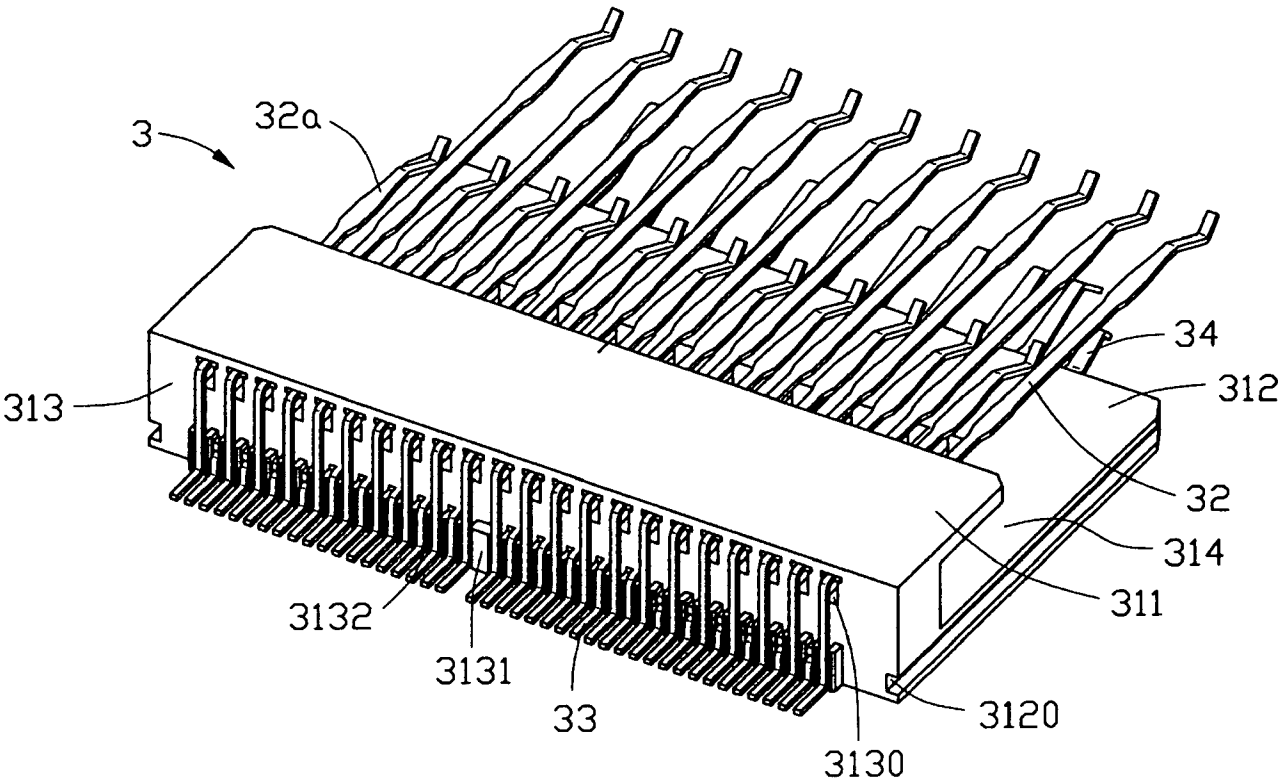
FIG. 6 is a perspective view of a terminal module shown in FIG. 4.
Figure 8:
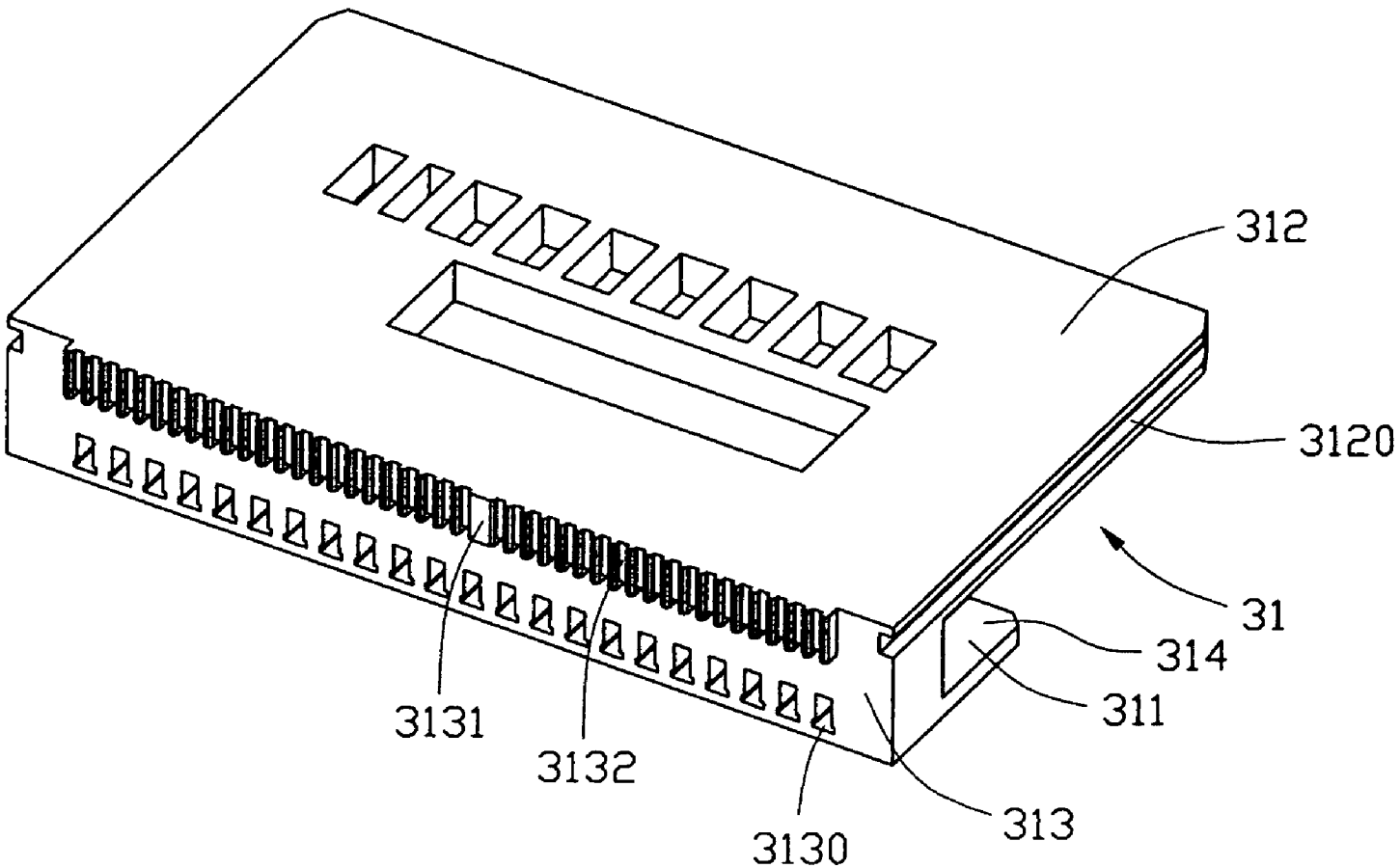
FIG. 8 is a perspective view of an insulative casing of the terminal module shown in FIG. 7.

As best shown in FIG. 8 in conjunction with FIG. 6, the insulative casing 31 comprises a first horizontal plate 311, a second horizontal plate 312 and a vertical plate 313 connecting rear portions of the first and the second horizontal plates 311, 312 to define a insertion space 314. The second horizontal plate 312 is essentially twice as length as the first horizontal plate 311. A pair of guiding slots 3120 are defined in opposite sides of the second horizontal plate 312 for engaging with the ribs 26 of the housing 2. The vertical plate 313 defines a plurality of T-shaped passageways 3130 adjacent to the first horizontal plate 311 and a plurality of comb passages 3132 adjacent to the second horizontal plate 312. A dividing wall 3131 is dimensioned to separate the comb passages 3132 into two portions. The dividing wall 3131 provides multiple functions such as providing polarization for the SM terminals 32 during assembling the terminal module 3, as will be discussed later.

Figure 9:
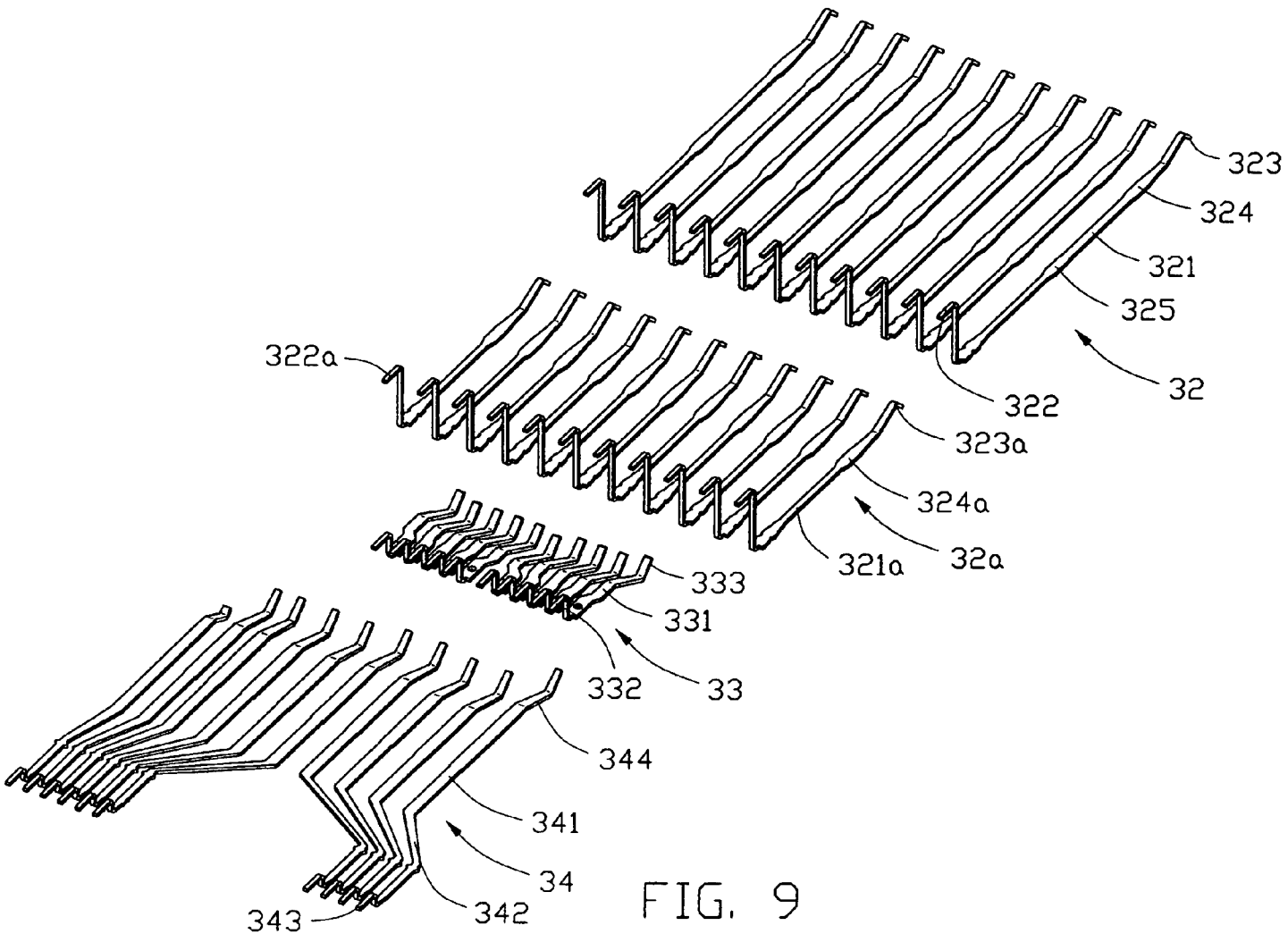
FIG. 9 is an exploded view of the terminal module shown in FIG. 6, wherein the insulative casing is taken away for clarity.
Figure 10:
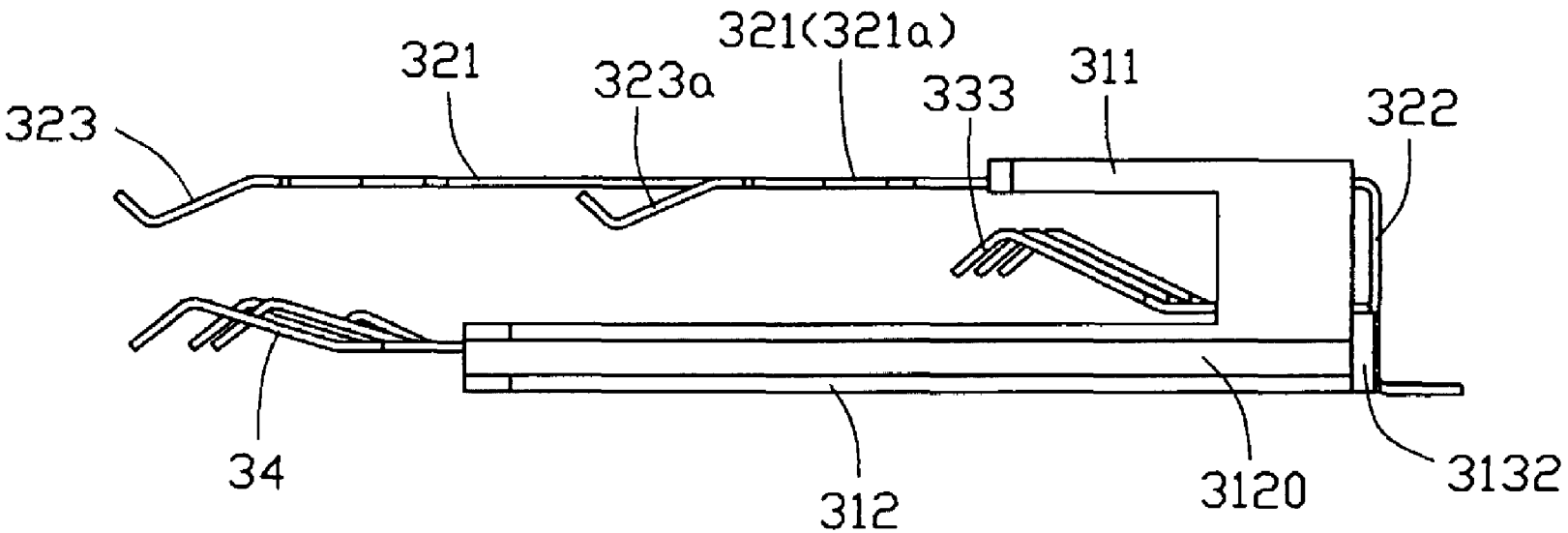
FIG. 10 is a left side elevational view of FIG. 6.

As best shown in FIGS. 8 and 9, the SM terminals 32 (32*a*) comprise two arrays of longer and shorter SM terminals 32, 32*a*. Each longer SM terminal 32 includes a middle SM body portion 321, a front V-shaped SM contacting portion 323 for electrically connecting with an SM card, and a rear L-shaped SM mounting portion 322 for being soldered to a circuit board (not shown), which is the electrical card connector mounted. The SM body portion 321 is substantially flat and has a front and rear enlarged portions 324, 325 widened laterally and outwardly for being received in the grooves 2032 of corresponding slots 2031 of the front and rear crossrails 203. The shorter SM terminals 32*a* and the longer SM terminals 32 are identical in configuration and structure except they are of different lengths. Similarly, each shorter SM terminal 32*a* includes a middle SM body portion 321*a*, a front V-shaped SM contacting portion 323*a* and a rear L-shaped SM mounting portion 322*a*. The SM body portion 321*a* of the shorter SM terminal 32*a* has an enlarged portion 324*a* for being received in the grooves 2032 of a corresponding slot 2031 of the rear crossrail 203.

Each MS terminal 33 comprises a MS body portion 331, a front MS contacting portion 333 for mating with a MS card and a rear L-shaped MS mounting portion 332 for being soldered to the circuit board. Each SD terminal 34 includes a middle SD body portion 341, a front SD contacting portion 344 adapted for a SD card, a rear L-shaped SD mounting portion 343 for being soldered to the circuit boards and a connecting portion 342 connecting the SD mounting portion 343 to the SD body portion 341. In the preferred embodiment, the SD terminals 34 are of ten pieces. Some connecting portions 342 of the SD terminals 34 are bent in a right-to-left direction, and the other pieces are bent in a left-to-right direction. Each L-shaped mounting portion 322, 332, 343 of the SM, MS and SD terminals 32, 33, 34 includes a vertical portion (not labeled) and a horizontal portion (not labeled) extending rearwardly from free a end of the vertical portion.

Referring now to FIG. 4, the positioning member 4 is of a generally elongated rectangular configuration and includes a base portion 41 and a pair of positioning arms 42 symmetrically extending downwardly from opposite sides of the base portion 41. The base portion 41 defines a plurality of positioning recesses 411 at a bottom edge thereof for receiving the SM, MS and SD mounting portions 322, 332, 343 of the SM, MS and SD terminals 32, 33, 34. The positioning arms 42 are provided for engaging with the embossments 271 of cavities 27 of the housing 2 to securely position the positioning number 4.

Referring to FIGS. 6–10, in assembly, firstly to assemble the terminal module 3, in the preferred embodiment, the MS terminals 33 and the SD terminals 34 are installed in respective ones of the comb passages 3132 of the casing 31. The MS body portions 331 of the MS terminals 33 and the SD body portions 341 of the SD terminals 34 are retained in the second horizontal plate 312 of casing 31, and the MS contacting portion 333 and the SD contacting portion 344 extend beyond the casing 31. It should be noted that the MS terminals 33 and the SD terminals 34 can also be integrally formed with the casing 31. The longer and shorter SM terminals 32, 32*a* are inserted into the casing 31 in a rear-to-front direction to form the terminal module 3. The longer and shorter SM body portions 321, 321*a* of two arrays of SM terminals 32 are alternately spaced along the passageways 3130 of the casing 31, and the longer and shorter SM mounting portions 322, 322*a* are partially received in the passageways 3130 of the casing 31.

Figure 2:
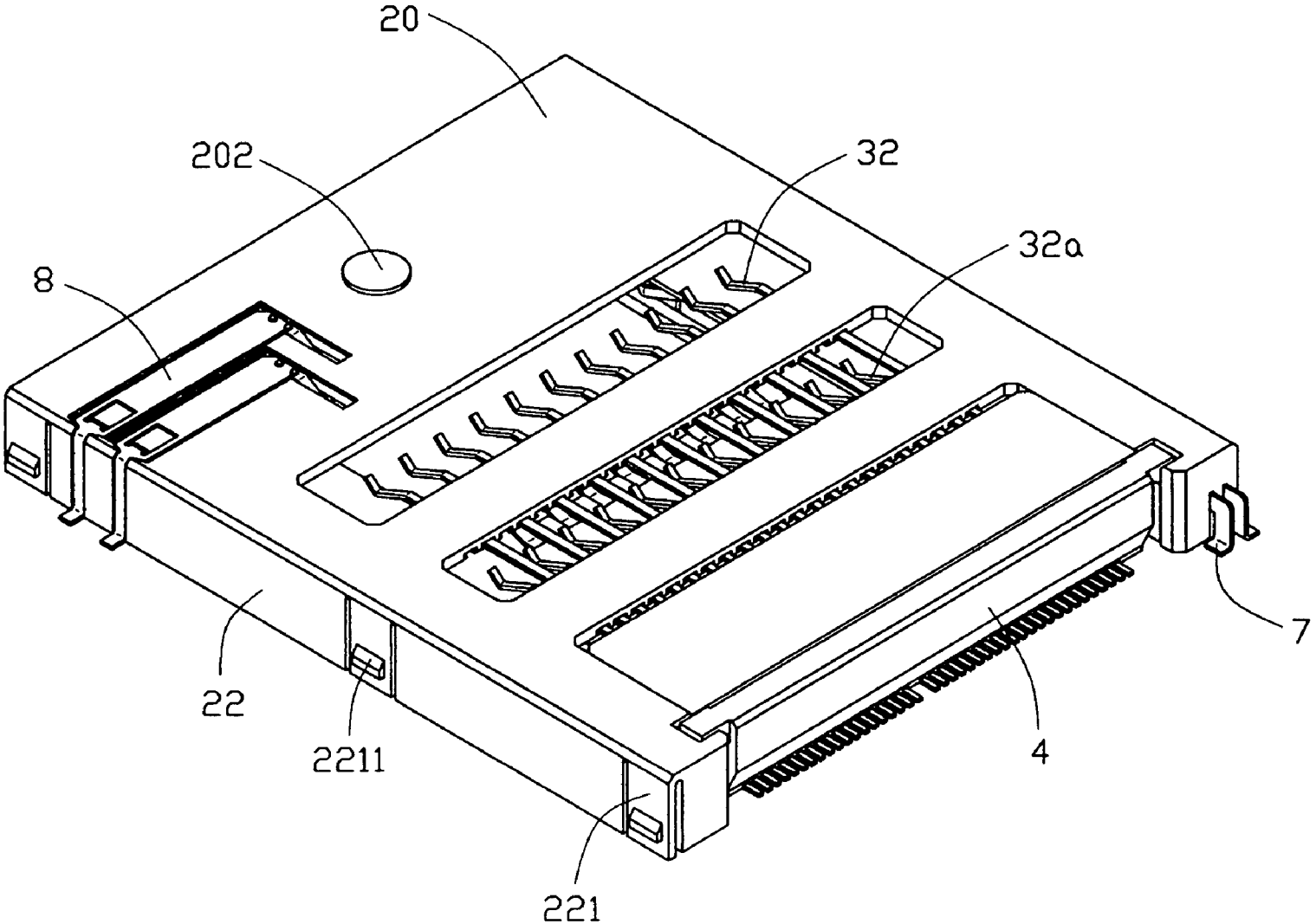
FIG. 2 is another perspective view of the card connector, wherein an outer shell is taken away.
Figure 3:
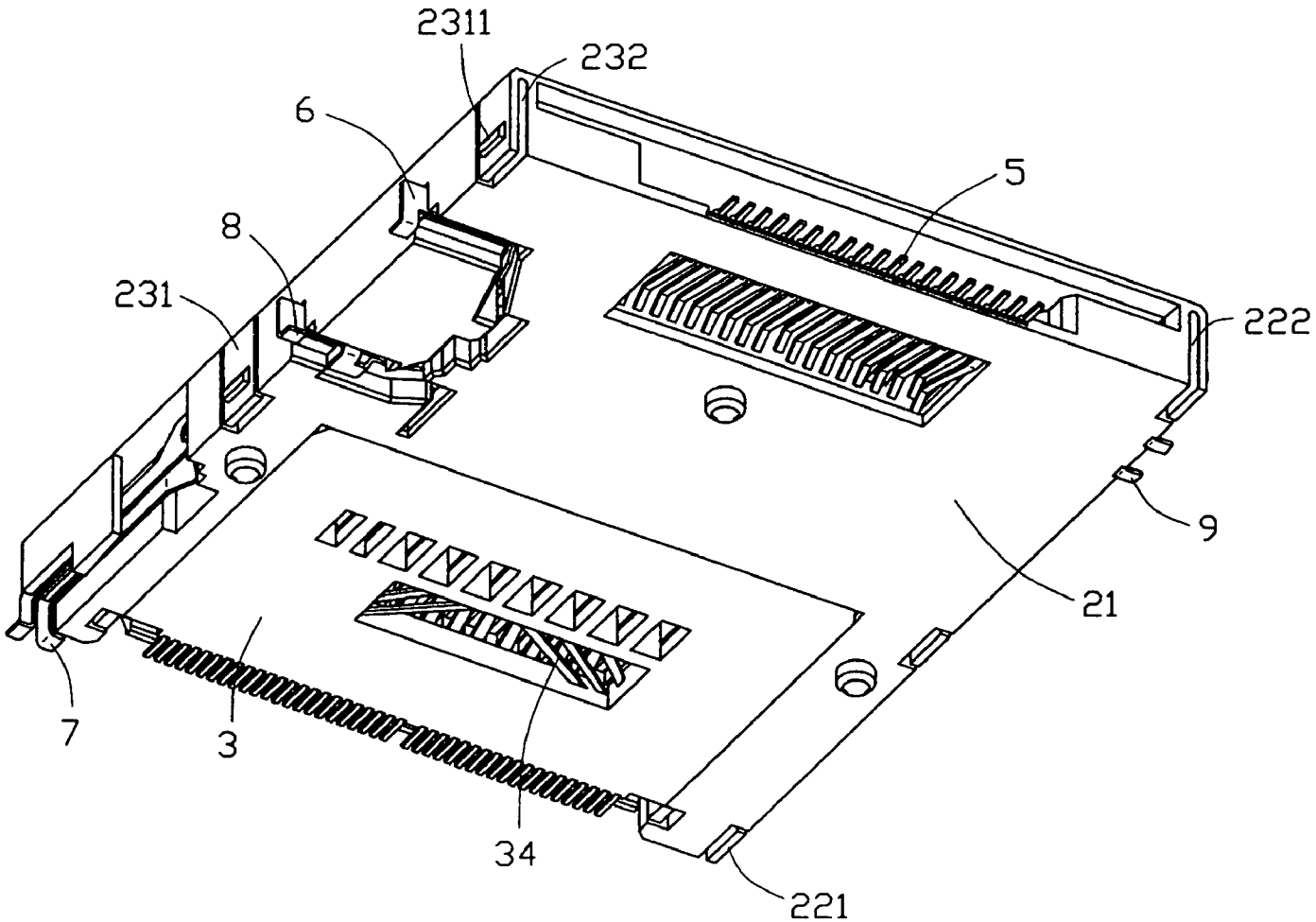
FIG. 3 is another perspective view of FIG. 2, taken from a bottom aspect.
Figure 7:
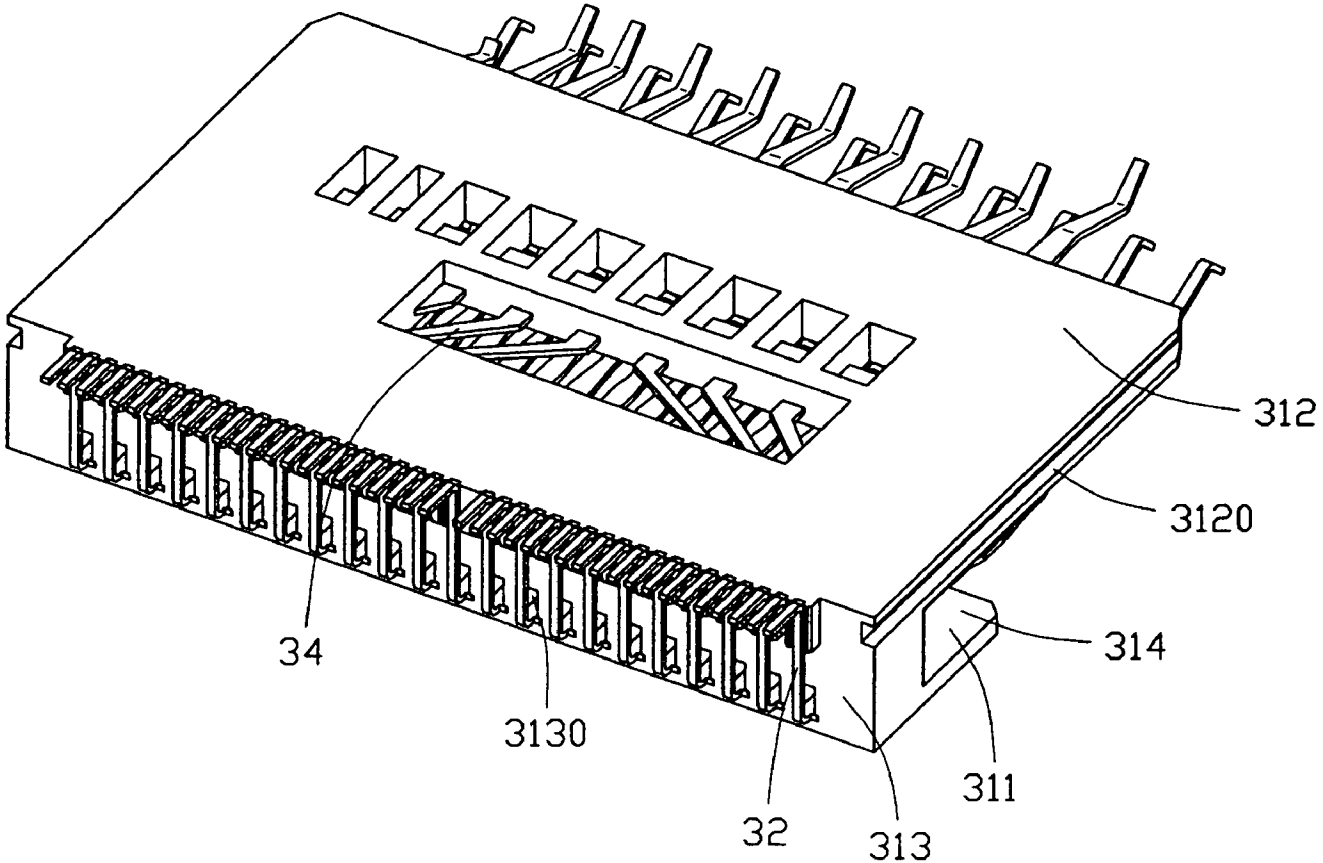
FIG. 7 is another perspective view of FIG. 6.

Referring to FIGS. 2, 3 and 4 in conjunction with FIGS. 5, 6 and 7, the terminal module 3 is installed in the housing 2. The second horizontal plate 312 of the casing 31 extends along the guiding columns 26 in a rear-to-front direction. The ribs 26 of the housing 2 are received in the guiding slots 3120. The longer and shorter SM terminals 32, 32*a* are alternately inserted into respective ones of the slots 2301 of the rear crossrail 203. The enlarged portions 324*a* of the shorter SM terminals 32*a* are snugly received in corresponding grooves 2032 of the slots 2031 of the rear crossrail 203, and the contacting portions 323*a* of the shorter SM terminals 32*a* extend beyond the slots 2031. The rear and front enlarged portions 325, 324 of the longer SM terminals 32 are respectively snugly received in grooves 2032 of the slots 2031 of the rear and front crossrails 203. Each SM, MS and SD contacting portions 323 (323*a*), 333, 344 of the SM, MS and SD terminals 32 (32*a*), 33, 34 extend into the card receiving space 24 and are appropriately curved inwardly, whereby the card can be smoothly inserted into the connector 100 to connect with corresponding terminals 32 (32*a*), 33, 34 without any jamming and buckling.

The positioning member 4 is attached to the housing 2 to accurately position the terminal module 3. The base portion 41 of the positioning number 4 abuts against the vertical plate 313 of the casing 31. The positioning arms 42 extend into the cavities 27 of the housing 2 and latch with the embossments 271. Horizontal portions of the SM, MS and SD mounting portions 322, 332, 343 of the SM, MS and SD terminals 32 (32*a*), 33, 34 are held in the positioning recesses 411 of the positioning number 4.

Referring to FIGS. 2 and 3 in conjunction with FIG. 4, the XD terminals 5 are installed in corresponding passages 211 of the housing 2 in a front-to-rear direction and are exposed in the card receiving space 24 for mating with the x-D picture card. The grounding contact 6 is fixed in the grounding contact mounting recess 212 of the bottom wall 21 of the housing 2. The switch contacts 7 are retained in the switch contact mounting recesses 233 of the right sidewall 23 of the housing 2. The written contact 8 is held in the written contact mounting recess 213 of the housing 2. The written protection contacts 9 are received in the written protection contact mounting recesses 201.

Referring to FIGS. 1 and 12 in conjunction with FIG. 4, the outer shell 1 is attached to the housing 2. The top plate 11 of the outer shell 1 adheres to the upper wall 20 of the housing 2. The protrusion 202 of the upper wall 20 of the housing 2 is interferentially fitted in the aperture 111 of top plate 11 of the outer shell 1. The rear plate 13 abuts against a rear portion of the base portion 41 of the positioning member 4. The locking portions 2211, 2311 of the flaps 221, 231 of the housing 2 are interference fitted in the locking holes 121 of the side plates 12, thereby securely assembling the outer shell 1 to the housing 2.

Due to the above-described structure of the card connector 100, when the side plates 12 of the outer shell 1 covers the left an right sidewalls 22, 23 of the housing 2, the cantilevered flaps 221, 231 of the left and right sidewalls 22, 23 are flexible to move inwardly into the gaps 222, 232. After the locking portions 2211, 2311 of the flaps latchably engaged with the locking holes 121 of the side plates 12, the flaps 221, 231 moves outwardly and come back to their normal positions. Thus, a reliable engagement between the outer shell 1 and the housing 2 is obtained.

While terms such "front", "rear", "upper", "lower", "left" and "right" have been used to help describe the invention as it is illustrated, it should be understood that the electrical connector 100 can be used in any orientation with respect to earth.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

an insulative housing including a card receiving space and an upper wall defining a row of slots extending through an inner side surface thereof;

a terminal module slidably assembled to the housing, the terminal module including an insulative casing and a plurality of first and second terminals, the first and second terminals respectively including first and second mounting portions fixed in the casing, first and second body portions respectively extending from the first and second mounting portions, and first and second contacting portions, the first and second body portion being alternately held in corresponding slots of the upper wall, the first and second contacting portions respectively extending from the first and second body portions and being arranged in two lines in the card receiving space; wherein the upper wall defines a front, middle and rear cutouts, thereby forming separate front and rear crossrails between adjacent two cutouts.

2. The electrical card connector according to claim 1, wherein the first terminal has a relatively longer length than that of the second terminal.

3. The electrical card connector according to claim 1, wherein the slot has a substantially T-shaped cross-section.

4. The electrical card connector according to claim 3, wherein each slot includes a pair of grooves extending laterally from inner side surfaces thereof.

5. The electrical card connector according to claim 4, wherein each first body portion is substantially flat and has first front and rear enlarged portions, the first front enlarged portion received in the grooves of a corresponding slot of the front crossrail, the first rear enlarged portion received in the grooves of a corresponding slot of the rear crossrail.

6. The electrical card connector according to claim 4, wherein each second body portion is substantially flat and has a second enlarged portion received in the grooves of corresponding slot of the rear crossrail.

7. The electrical card connector according to claim 1, wherein the housing includes a pair of sidewalls, each sidewall providing an elastic flap having an outwardly projecting locking portion, the flaps being movable sidewardly under an external force.

8. The electrical card connector according to claim 7, wherein each sidewall of the housing defines a gap from the flap.

9. The electrical card connector according to claim 7, wherein the locking portion of the flap has a substantially trapeziform cross-section and includes an inclined top surface and a bottom surface perpendicular to an outer side surface of the flap.

10. The electrical card connector according to claim 7, further including a metal shell substantially covering the housing, the shell including a pair of side plates each defining a locking hole engaging with the locking portion of the flap of the housing.

11. The electrical card connector according to claim 1, wherein the insulative casing defines a plurality of comb passages, the first and second terminals being alternately received in corresponding comb passages.

12. The electrical card connector according to claim 11, wherein the housing includes a pair of ribs projecting inwardly from opposite sides thereof, and wherein the casing defines a pair of guiding slots in opposite sides thereof engaged with the corresponding ribs of the housing.

13. An electrical card connector comprising:

an insulative housing including a card receiving space and an upper wall defining a row of slots extending through an inner side surface thereof;

a terminal module slidably assembled to the housing, the terminal module including an insulative casing and a plurality of first and second terminals, the first and second terminals respectively including first and second mounting portions fixed in the casing, first and second body portions respectively extending from the first and second mounting portions, and first and second contacting portions, the first and second body portion being alternately held in corresponding slots of the upper wall, the first and second contacting portions respectively extending from the first and second body portions and being arranged in two lines in the card receiving space; wherein the insulating casing comprises a first horizontal plate, a second horizontal plate and a vertical plate connecting rear portions of the first and second horizontal plates.

14. The electrical card connector according to claim 13, wherein the first and second body portions are received in the vertical plate, and wherein the first and second mounting portions are held in a plurality of combo passages disposed on lower outside of the vertical plate adjacent to the first horizontal plate.

* * * * *